US006513947B1

(12) United States Patent
Huang

(10) Patent No.: US 6,513,947 B1
(45) Date of Patent: Feb. 4, 2003

(54) FLASHLIGHT HAVING A WATER-RESISTANT SWITCH

(75) Inventor: Shou-Chen Huang, Taipei (TW)

(73) Assignee: Kingwell Products Inc., Taipei (TW)

( * ) Notice: Subject to any disclaimer, the term of this patent is extended or adjusted under 35 U.S.C. 154(b) by 0 days.

(21) Appl. No.: 10/032,004

(22) Filed: Dec. 31, 2001

(51) Int. Cl.[7] ..... H01H 13/06
(52) U.S. Cl. ..... 362/206; 362/208; 362/394
(58) Field of Search ..... 362/200, 206, 362/204, 205, 208, 802, 267, 394

(56) References Cited

U.S. PATENT DOCUMENTS 4,733,337 A * 3/1988 Bieberstein ..... 362/157
5,629,105 A * 5/1997 Matthews ..... 200/302.2
5,990,430 A * 11/1999 Shiau ..... 200/302.2

* cited by examiner

*Primary Examiner*—Sandra O'Shea
*Assistant Examiner*—Hargobind S. Sawhney

(74) *Attorney, Agent, or Firm*—Rosenberg, Klein & Lee

(57) ABSTRACT

A flashlight having a water-resistant switch comprises a battery compartment, a hollow rear barrel, a rubber push button, an abutment cylinder, a conductive metal block, a first spring, an engagement cylinder, an insulator washer, a pin member, and a second spring. Battery compartment is coupled to rear barrel to a conductive element. Further, the relative position of battery compartment and rear barrel can be adjusted by threading. Rear barrel comprises a hole with push button projected therefrom. Abutment cylinder is threadedly secured in rear barrel to fasten push button. Metal block is provided between abutment cylinder and push button. First spring is urged between metal block and abutment cylinder. Engagement cylinder is threadedly secured in rear barrel. Insulator washer is fastened between engagement cylinder and abutment cylinder. Pin member is received in engagement cylinder. Second spring is urged between pin member and insulator washer. With pin member electrically coupled to cells, in addition to water-resistant the switch is capable of being operated in either pressing or rotation operating mode by pressing push button or rotating rear barrel.

11 Claims, 6 Drawing Sheets

FLASHLIGHT HAVING A WATER-RESISTANT SWITCH

FIELD OF THE INVENTION

The present invention relates to flashlights and more particularly to such a flashlight having a water-resistant switch which is capable of being operated in either pressing or rotation operating mode.

BACKGROUND OF THE INVENTION

A conventional flashlight may incorporate a specially designed switch depending on applications. For example, there are various water-resistant flashlights commercially available in which water-resistant switch is the most important device of the flashlight. A conventional flashlight having a water-resistant switch is shown in FIGS. 1 and 2. The switch is located at rear of flashlight and is operated by pressing. In details, switch is operated by pressing by palm of user's hand while holding the flashlight. This design is significantly different from other conventional sliding switches in sidewalls of their battery compartment. Recently, flashlights having such operated switches are becoming more and more popular in the field of mini-flashlights. As shown, flashlight 90 comprises a hollow rear barrel 91 sleeved on a rear extension of flashlight 90, a rubber push button 94 fitted in rear end of hollow rear barrel 91, a conductive metal block 93 inside hollow rear barrel 91 secured to rubber push button 94, and a spring 92 having a rear end anchored at conductive metal block 93 and a front end urged against terminals of cells. In an unused state (i.e., bulb of flashlight is not lit), a circumferential shoulder 95 of flashlight 90 inside hollow rear barrel 91 is disengaged from conductive metal block 93 (FIG. 1). In operation, press rubber push button 94 by palm of user's hand to cause conductive metal block 93 to engage with the circumferential shoulder 95 by compressing spring 92 (FIG. 2). As a result, bulb of flashlight is lit. A release of force exerted on rubber push button 94 will turn off the flashlight due to the expansion of spring 92. However, the water-resistant property of such flashlight is not reliable because water may flow into flashlight through the periphery where rubber push button 94 contacts hollow rear barrel 91.

Thus, it is desirable to provide a flashlight having a water-resistant switch with improved characteristics in order to overcome the above drawback of prior art.

SUMMARY OF THE INVENTION

It is an object of the present invention to provide a flashlight having a reliable, durable water-resistant switch.

It is another object of the present invention to provide a flashlight having a water-resistant switch which is capable of being operated in either pressing or rotation operating mode.

In one aspect of the present invention, there is provided a flashlight having a water-resistant switch comprising a battery compartment, a hollow rear barrel, a rubber push button, an abutment cylinder, a conductive metal block, a first spring, an engagement cylinder, an insulator washer, a pin member, and a second spring wherein the battery compartment includes a space for receiving cells and an externally threaded extension on a rear end facing the hollow rear barrel, the hollow rear barrel includes internal threads which are engageable with threads of the externally threaded extension and a hole on a rear end, the rubber push button includes a peripheral flange and a raised portion projected from the hole of the hollow rear barrel, the abutment cylinder includes external threads which are engageable with the internal threads of the hollow rear barrel to fasten the peripheral flange of the rubber push button, and a central hole, the conductive metal block is provided between the abutment cylinder and the rubber push button and includes a rod projected through the central hole of the abutment cylinder, the first spring is put on the rod of the conductive metal block being urged between the conductive metal block and the abutment cylinder, the engagement cylinder is formed of hard plastic material and includes an peripheral extension, a central hole, and external threads on the peripheral extension, the external threads being engageable with the hollow rear barrel, the insulator washer is fastened between the engagement cylinder and the abutment cylinder and includes a central hole, the pin member is received in the engagement cylinder and includes a rod projected through the central hole of the engagement cylinder to contact the cell in the battery compartment, and the second spring is urged between the pin member and the insulator washer.

In another aspect of the present invention, there is provided a flashlight having a water-resistant switch comprising a battery compartment, a hollow rear barrel coupled to the battery compartment, a rubber push button projected from the hollow rear barrel, an abutment cylinder threadedly secured within the hollow rear barrel to urge the rubber push button against a rear end of the hollow rear barrel, and a conductive metal block in the hollow rear barrel wherein the conductive metal block is operative to be pushed forward by the rubber push button to form a closed circuit of the flashlight.

The above and other objects, features and advantages of the present invention will become apparent from the following detailed description taken with the accompanying drawings.

DETAILED DESCRIPTION OF THE PREFERRED EMBODIMENTS

Figure 2:
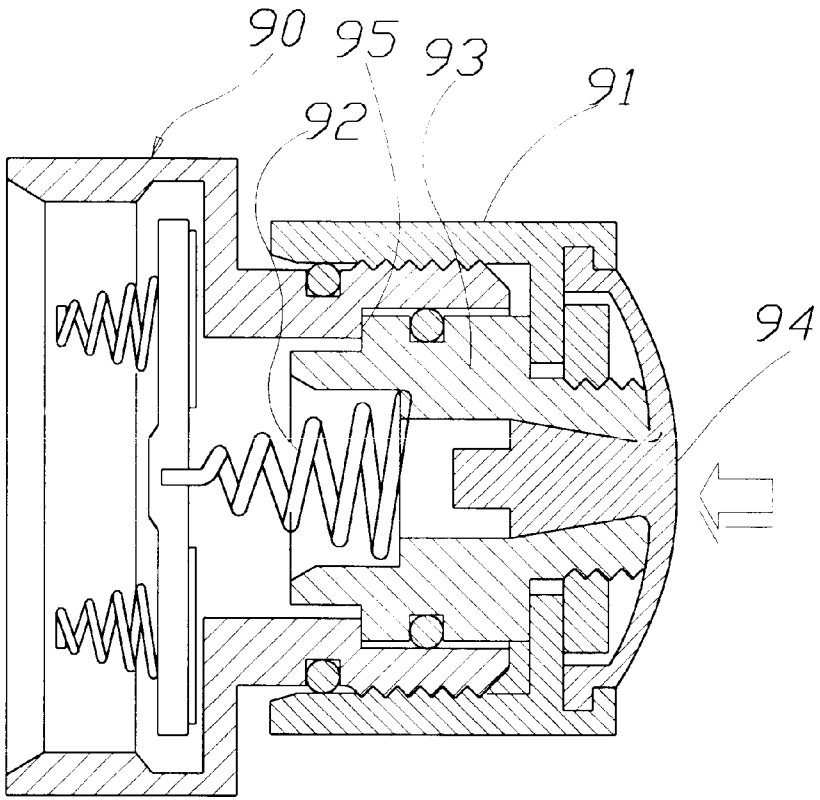
FIG. 2 is view similar to FIG. 1 where flashlight is on to emit light.
Figure 1:
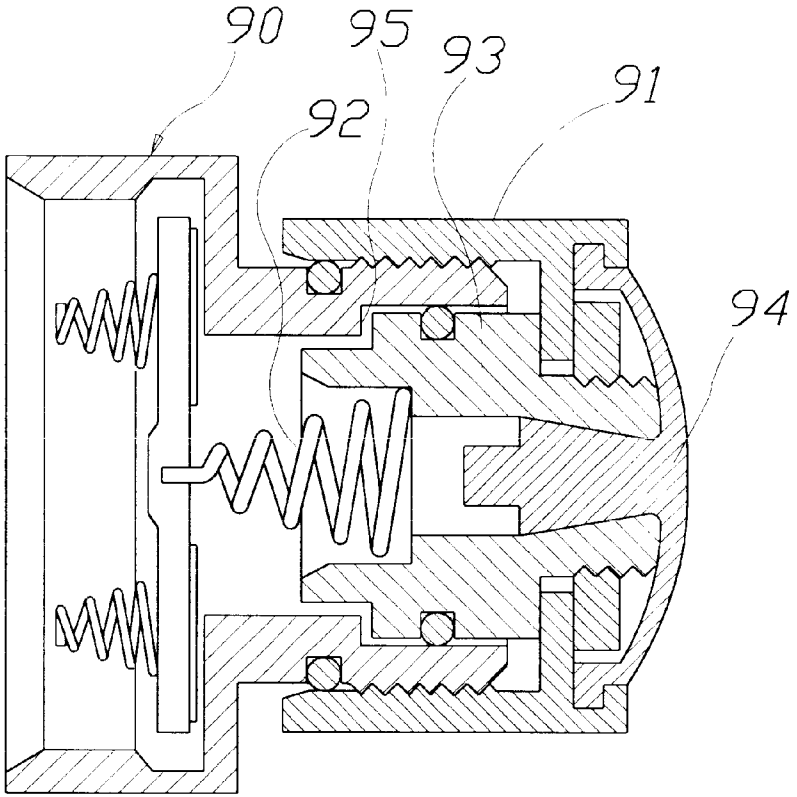
FIG. 1 is a cross-sectional view of rear portion of a conventional flashlight having a water-resistant switch where flashlight is off.
Figure 3:
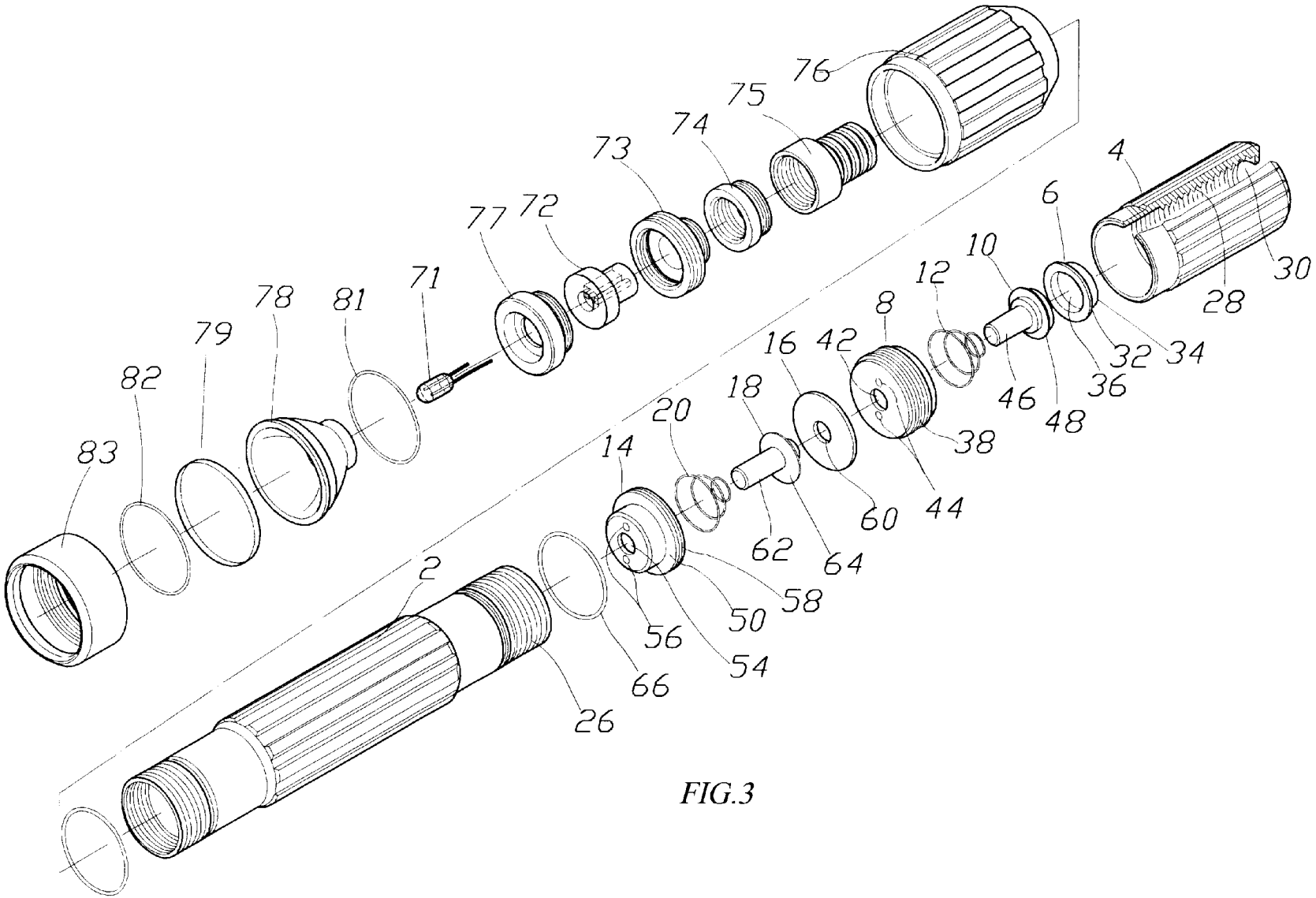
FIG. 3 is an exploded view of a preferred embodiment of flashlight according to the invention.
Figure 4:
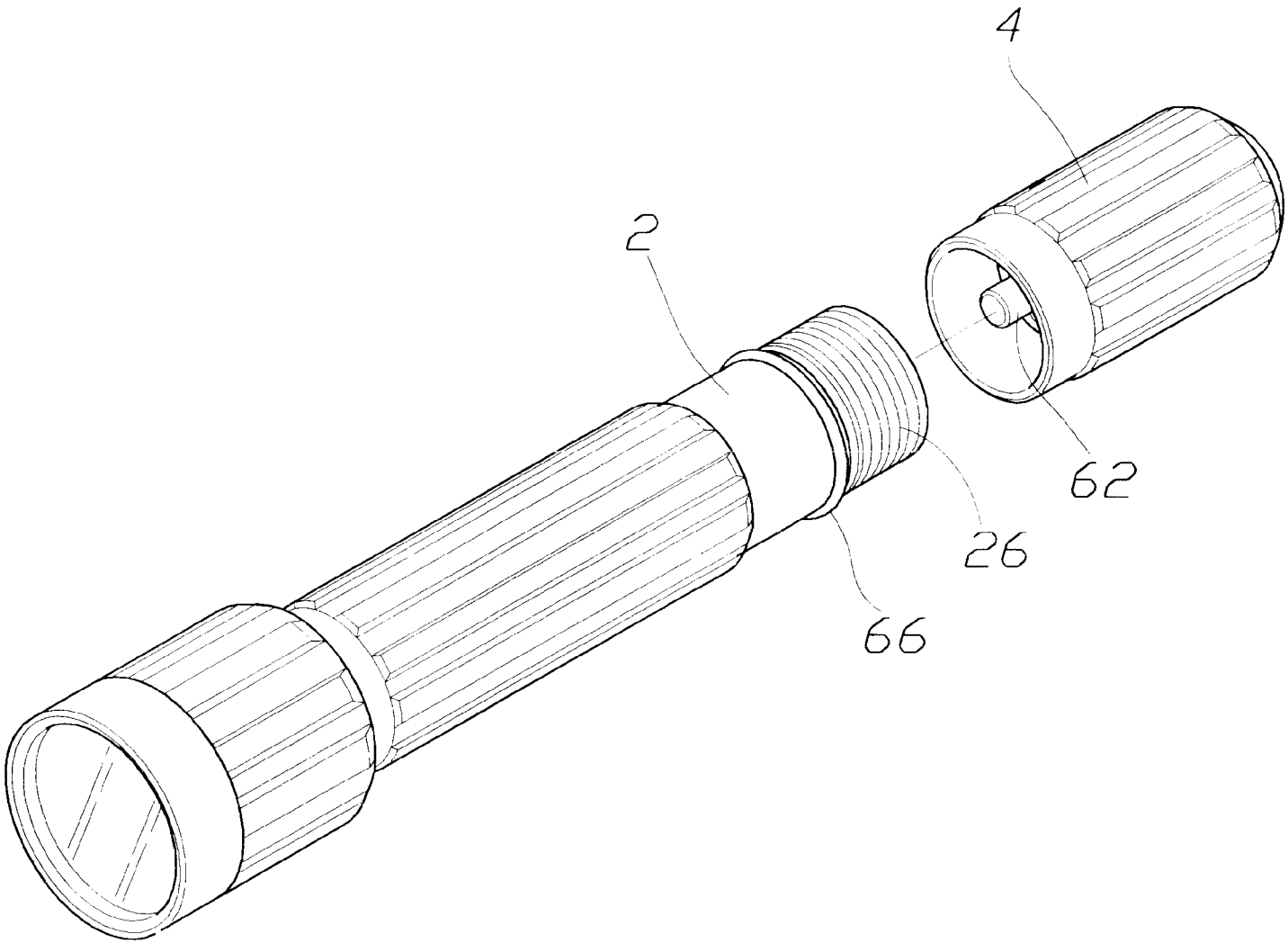
FIG. 4 is a perspective view of the partially assembled flashlight.
Figure 5:
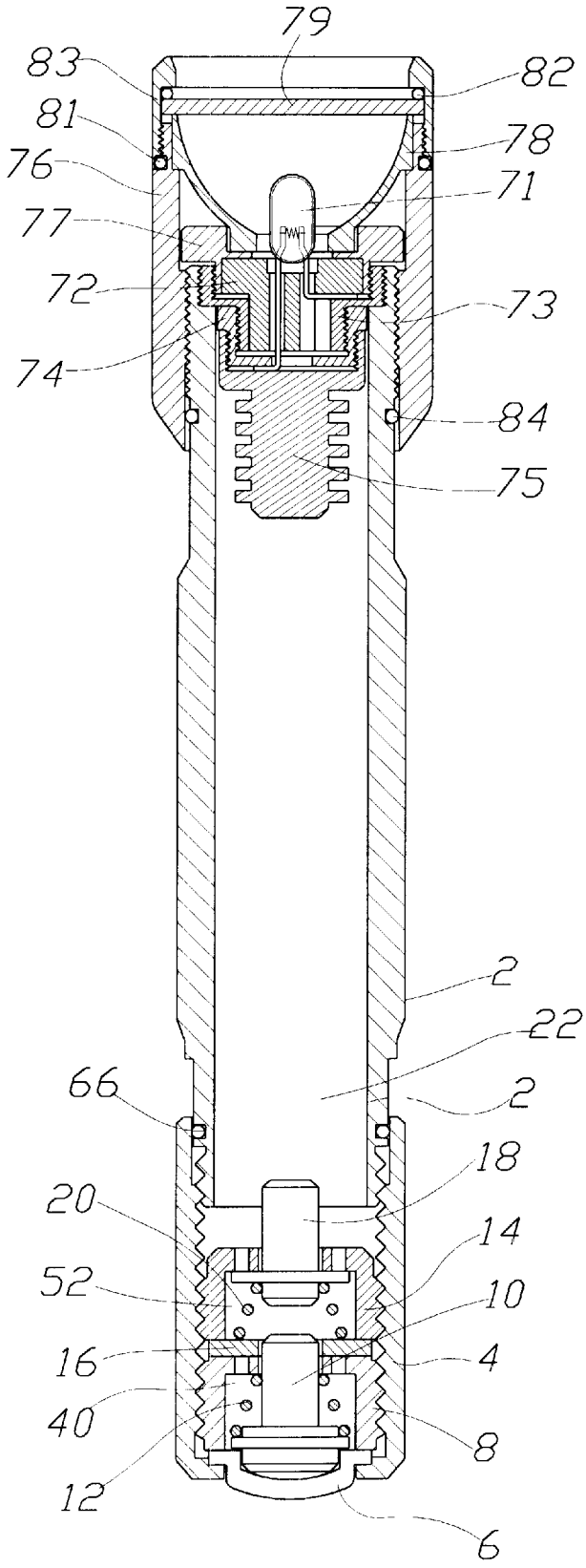
FIG. 5 is a cross-sectional view of the assembled flashlight.

Referring to FIGS. 3 to 5, there is shown a flashlight constructed in accordance with the invention comprising a head assembly and a rear assembly. Rear assembly comprises a battery compartment 2, a hollow rear barrel 4, a rubber push button 6, an abutment cylinder 8, a conductive metal block 10, a first spring 12, an engagement cylinder 14, an insulator washer 16, a pin member 18, and a second spring 20. A space 22 is formed in battery compartment 2 for receiving cells (see FIG. 6). An externally threaded extension 26 is formed on rear end of battery compartment 2 facing hollow rear barrel 4. An O-ring 66 is put on battery compartment 2 abutted the externally threaded extension 26. Hollow rear barrel 4 has internal threads 28 which are engageable with threads of the externally threaded extension 26. Hollow rear barrel 4 further has a hole 30 on rear end. Rubber push button 6 is shaped like a brimmed hat and comprises a peripheral flange 32, a raised portion 34, and a cavity 36. Rubber push button 6 is provided at the rear end of hollow rear barrel 4 with raised portion 34 projected from hole 30 of hollow rear barrel 4. Abutment cylinder 8 has external threads 38 which are engageable with internal threads 28 of hollow rear barrel 4 to fasten peripheral flange 32 of rubber push button 6. Abutment cylinder 8 further comprises a rear space 40 (see FIG. 5), a central hole 42, and two positioning apertures 44 which are operative to cooperate with hand tools to thread abutment cylinder 8 into hollow rear barrel 4. Conductive metal block 10 is provided between abutment cylinder 8 and rubber push button 6 and comprises a rod 46 projected through central hole 42 of abutment cylinder 8 and a disk member 48. First spring 12 is put on rod 46 and is provided in space 40 of abutment cylinder 8 being urged between disk member.48 of conductive metal block 10 and abutment cylinder 8. Engagement cylinder 14 is formed of hard plastic material and comprises a peripheral extension 50, a space 52, a central hole 54, two positioning apertures 56, and external threads 58 on peripheral extension 50. Positioning apertures 56 are operative to cooperate with hand tools to thread engagement cylinder 14 into. hollow rear barrel 4. Insulator washer 16 is fastened between engagement cylinder 14 and abutment cylinder 8 and comprises a central hole 60 for permitting rod 46 of conductive metal block 10 to pass through. Pin member 18 is received in space 52 of engagement cylinder 14 and comprises a rod 62 projected through central hole 54 of engagement cylinder 14 to contact cell 24 in battery compartment 2 (FIG. 6) and a disk member 64. Second spring 20 is provided in space 52 of engagement cylinder 14 being urged between disk member 64 of pin member 18 and insulator washer 16 so as to project rod 62 of pin member 18 from central hole 54 of engagement cylinder 14 in an unused state.

Head assembly comprises a bulb 71, an insulator socket 72, a bulb holder 73, an insulator barrel 74, a conductive barrel 75, a hollow front barrel 76, and a socket holder 77. Bulb 71 has long and short pins which are inserted into insulator socket 72. Further, bulb holder 73, insulator barrel 74, conductive barrel 75, and hollow front barrel 76 are assembled together as shown in FIG. 5. Finally, couple hollow front barrel 76 and battery compartment 2 by threading for securing head assembly to battery compartment 2.

A reflector 78 is provided in hollow front barrel 76. A lens holder 83 is threadedly secured to hollow front barrel 76. A first O-ring 82 and lens 79 are provided in lens holder 83. A second O-ring 81 is provided between lens holder 83 and hollow front barrel 76. Reflector 78 is secured to socket holder 77. A third O-ring 84 is provided between hollow front barrel 76 and battery compartment 2. This completes a flashlight having a water-resistant switch.

Figure 6:
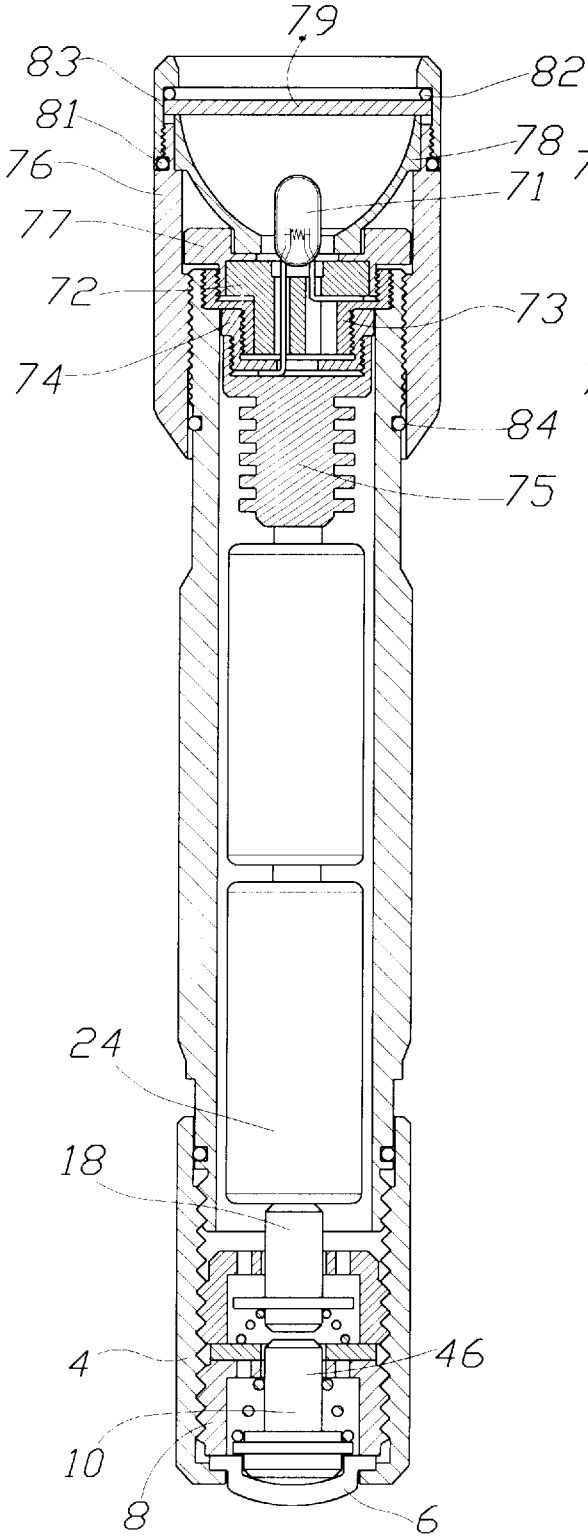
FIGS. 6 and 7 are views similar to FIG. 5 showing off and on states of flashlight by releasing and pressing rubber push button respectively.
Figure 7:
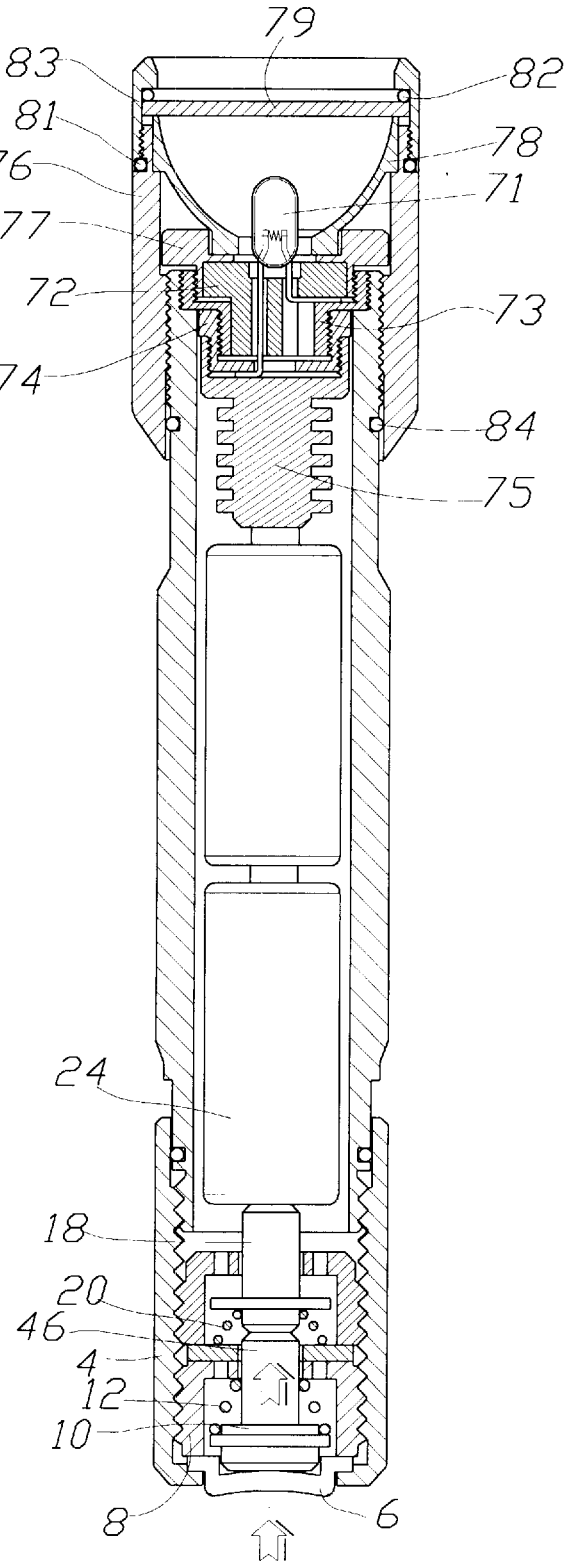

Referring to FIGS. 6 and 7, a pressing operating mode of the flashlight will now be described below. First press rubber push button 6 to push conductive metal block 10 forward. In response, rod 46 of conductive metal block 10 contacts pin member 18 which is electrically coupled to a negative terminal of cell 24. As a result, a closed circuit is formed, thus enabling the bulb 71 to light (see FIG. 7). When force exerted on rubber push button 6 is released, energized force of first spring. 12 will push rod 46 rearward to disengage pin member 18 from rod 46. As a result, the circuit is open, thus disabling the bulb 71 (see FIG. 6). Moreover, rubber push button 6 is threadedly secured to hollow rear barrel 4 by abutment cylinder 8. In addition, conductive metal block 10 is urged against rubber push button 6 by the elastic force of first spring 12. Hence, the provision of rubber push button 6 can effect a water-resistant switch irrespective of whether flashlight is activated or not.

Figure 8:
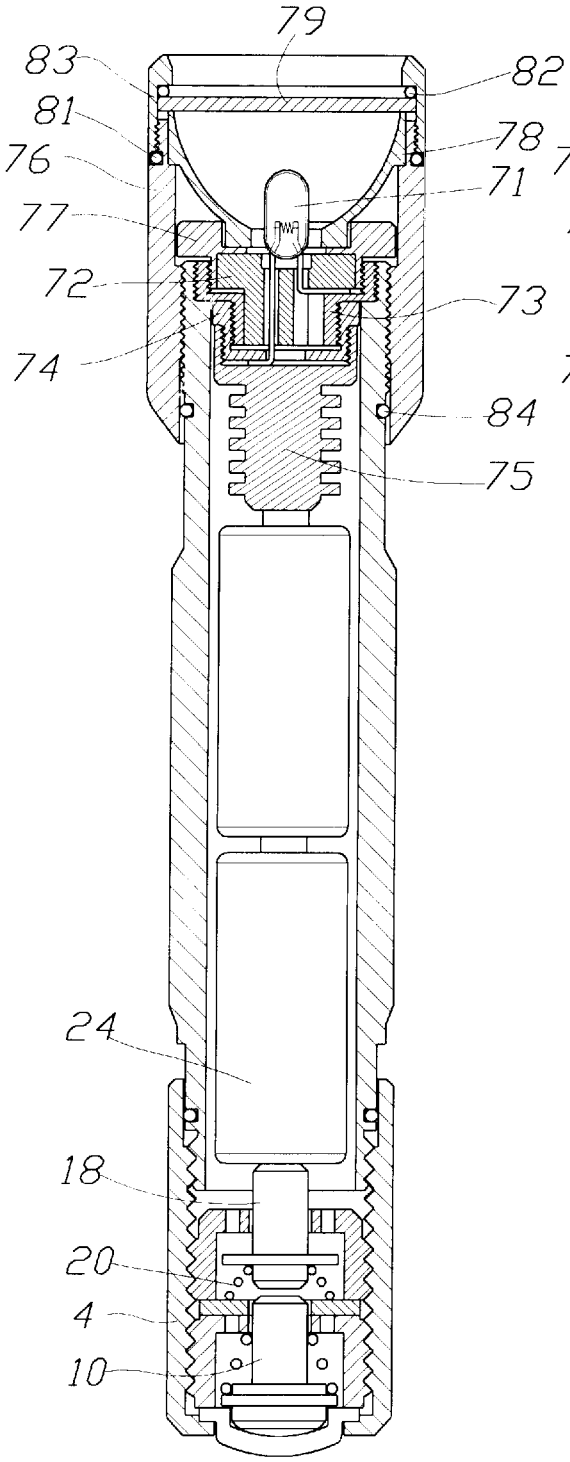
FIGS. 8 and 9 are views similar to FIG. 5 showing off and on states of flashlight by rotating hollow rear barrel rearward and forward respectively.
Figure 9:
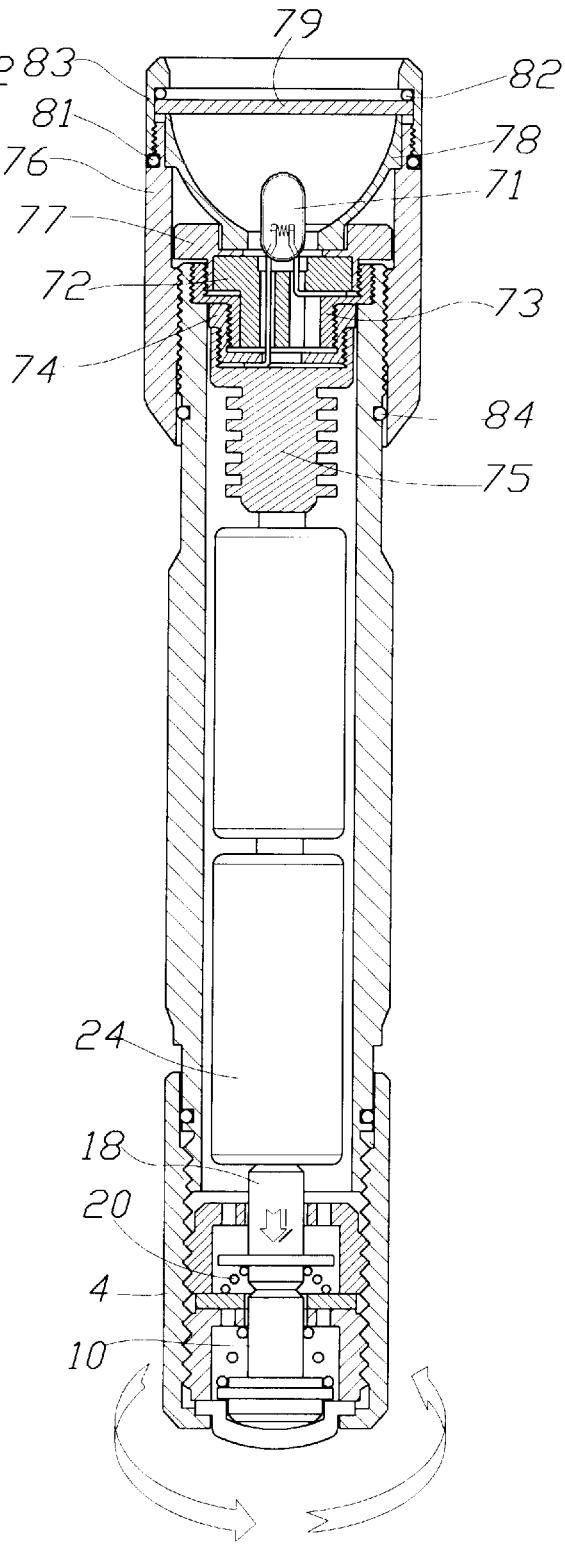

Referring to FIGS. 8 and 9, a rotation operating mode of the flashlight will now be described below. First rotate hollow rear barrel 4 forward to push pin member 18 to contact cell 24. Continue the forward rotation of hollow rear barrel 4 to compress second spring 20 for moving second spring 20 rearward. As a result, pin member 18 contacts conductive metal block 10 for closing the circuit to enable the bulb 71 (see FIG. 9). When rotate hollow rear barrel 4 rearward, pin member 18 is pushed by second spring 20 to disengage from conductive metal block 10. As a result, the circuit is open, thus disabling the bulb 71 (see FIG. 8).

While the invention herein disclosed has been described by means of specific embodiments, numerous modifications and variations could be made thereto by those skilled in the art without departing from the scope and spirit of the invention set forth in the claims.

What is claimed is:

1. A flashlight having a water-resistant switch comprising a battery compartment, a hollow rear barrel, a rubber push button, an abutment cylinder, a conductive metal block, a first spring, an engagement cylinder, an insulator washer, a pin member, and a second spring wherein the battery compartment includes a space for receiving cells and an externally threaded extension on a rear end facing the hollow rear barrel, the hollow rear barrel includes internal threads which are engageable with threads of the externally threaded extension and a hole on a rear end, the rubber push button includes a peripheral flange and a raised portion projected from the hole of the hollow rear barrel, the abutment cylinder includes external threads which are engageable with the internal threads of the hollow rear barrel to fasten the peripheral flange of the rubber push button, and a central hole, the conductive metal block is provided between the abutment cylinder and the rubber push button and includes a rod projected through the central hole of the abutment cylinder, the first spring is put on the rod of the conductive metal block being urged between the conductive metal block and the abutment cylinder, the engagement cylinder is formed of hard plastic material and includes a peripheral extension, a central hole, and external threads on the peripheral extension, the external threads being engageable with the hollow rear barrel, the insulator washer is fastened between the engagement cylinder and the abutment cylinder and includes a central hole, the pin member is received in the engagement cylinder and includes a rod projected through the central hole of the engagement cylinder to contact the cell in the battery compartment, and the second spring is urged between the pin member and the insulator washer.

2. The flashlight of claim 1, wherein the rubber push button is shaped like a brimmed hat.

3. The flashlight of claim 1, wherein the abutment cylinder further comprises a space for receiving the conductive metal block and the first spring.

4. The flashlight of claim 1, wherein the abutment cylinder further comprises two positioning apertures which are operative to cooperate with hand tools to thread the abutment cylinder into the hollow rear barrel.

5. The flashlight of claim 1, wherein the conductive metal block further comprises a disk member to urge against the first spring.

6. The flashlight of claim 1, wherein the engagement cylinder further comprises a space for receiving the pin member and the second spring.

7. The flashlight of claim 1, wherein the engagement cylinder further comprises two positioning apertures which are operative to cooperate with hand tools to thread the engagement cylinder into the hollow rear barrel.

8. The flashlight of claim 1, wherein the pin member further comprises a disk member to urge against the second spring.

9. A flashlight having a water-resistant switch comprising a battery compartment, a hollow rear barrel coupled to the battery compartment, a rubber push button projected from the hollow rear barrel, an abutment cylinder threadedly secured within the hollow rear barrel to urge the rubber push button against a rear end of the hollow rear barrel, and a conductive metal block in the hollow rear barrel wherein the conductive metal block is operative to be pushed forward by the rubber push button to form a closed circuit of the flashlight.

10. The flashlight of claim 9, further comprising a spring between the abutment cylinder and the conductive metal block.

11. The flashlight of claim 9, wherein the conductive metal block comprises a rod and the abutment cylinder comprises a central hole with the rod of the conductive metal block passed through.

* * * * *